US010449769B2

(12) United States Patent
Karppinen

(10) Patent No.: US 10,449,769 B2
(45) Date of Patent: Oct. 22, 2019

(54) HYBRID PRINTHEAD MAINTENANCE SYSTEM FOR WIPING AND PRIMING

(71) Applicant: MEMJET TECHNOLOGY LIMITED, Dublin (IE)

(72) Inventor: Vesa Karppinen, North Ryde (AU)

(73) Assignee: Memjet Technology Limited (IE)

( * ) Notice: Subject to any disclaimer, the term of this patent is extended or adjusted under 35 U.S.C. 154(b) by 54 days.

(21) Appl. No.: 15/922,679

(22) Filed: Mar. 15, 2018

(65) Prior Publication Data

US 2018/0264826 A1 Sep. 20, 2018

Related U.S. Application Data

(60) Provisional application No. 62/473,150, filed on Mar. 17, 2017.

(51) Int. Cl.
*B41J 2/165* (2006.01)

(52) U.S. Cl.
CPC ..... *B41J 2/16544* (2013.01); *B41J 2/16532* (2013.01); *B41J 2/16535* (2013.01); *B41J 2/16552* (2013.01); *B41J 2/16579* (2013.01); *B41J 2/16585* (2013.01); *B41J 2002/16555* (2013.01)

(58) Field of Classification Search
CPC .. B41J 2/16547; B41J 2/16585; B41J 2/1652; B41J 2/16517; B41J 2/16552; B41J 2/16535; B41J 2/16511; B41J 2/16544; B41J 2/16505; B41J 2/16579; B41J 2002/16555
USPC ..... 347/29, 30, 32, 33
See application file for complete search history.

(56) References Cited

U.S. PATENT DOCUMENTS

| | | | | |
|---|---|---|---|---|
| 2009/0179940 | A1* | 7/2009 | Hibbard | B41J 2/16547 347/31 |
| 2011/0043567 | A1* | 2/2011 | Jung | B41J 2/16535 347/33 |
| 2013/0106951 | A1* | 5/2013 | Karppinen | B41J 2/16535 347/33 |

* cited by examiner

*Primary Examiner* — Jannelle M Lebron
(74) *Attorney, Agent, or Firm* — Cooley LLP

(57) ABSTRACT

A maintenance system for maintaining an elongate inkjet printhead. The maintenance system includes: a carriage movable longitudinally along the printhead, the carriage including a maintenance member having a primary suction nozzle facing inkjet nozzles of the printhead and a wiper adjacent the primary suction nozzle; a traversing mechanism for traversing the carriage longitudinally along the printhead; and an engagement mechanism for urging the wiper and the printhead into engagement with each other. During use, the wiper contacts a non-printing part of the printhead and the primary suction nozzle is spaced apart from the printhead.

14 Claims, 5 Drawing Sheets

HYBRID PRINTHEAD MAINTENANCE SYSTEM FOR WIPING AND PRIMING

CROSS-REFERENCE TO RELATED APPLICATIONS

The present application claims the benefit of priority under 35 U.S.C. § 119(e) of U.S. Provisional Application Ser. No. 62/473,150, entitled HYBRID PRINTHEAD MAINTENANCE SYSTEM FOR WIPING AND PRIMING, filed Mar. 17, 2017, the content of which is hereby incorporated by reference in its entirety for all purposes.

FIELD OF THE INVENTION

This invention relates to a maintenance system for inkjet printheads. It has been developed primarily for efficient wiping and priming of elongate printheads of the type used in pagewide printing.

BACKGROUND OF THE INVENTION

The Applicant has previously described a number of different maintenance and ink delivery systems for maintaining healthy inkjet nozzles in pagewide printheads. In order to print optimally from an inkjet printhead, at least two requirements must be met: (1) the printhead face should be free of any flooded ink; and (2) the inkjet nozzles should be free of any viscous plugs of ink, particles/fibers and air bubbles.

In order to meet the first requirement, printheads typically require wiping to remove flooded ink. Wiping may be either along a longitudinal extent of the printhead (see, for example, WO2013/059853) or transversely across the printhead (see, for example, WO2011/143699). The wiper may be wet or dry, depending to some extent on the characteristics of the ink (e.g. dye-based or pigment-based ink).

In order to meet the second requirement, printers are typically equipped with an ink delivery system, which can force ink from nozzles so as to remove air bubbles and viscous ink plugs. For example, WO2011/143698 describes an ink delivery system having a pump, which in combination with a pinch valve, is used to force ink through inkjet nozzles in a pressure-priming operation. Subsequent spitting of ink into a spittoon may be used to maintain healthy nozzles until the printhead is ready to print.

Pigment-based inks generally present greater challenges for maintenance systems than dye-based inks. Since pigments are prone to precipitate from inks and clog wet wipers, dry wiping is usually the only option for wiping pigment-based inks. Dry wiping requires wiping a relatively clean, dry portion of wiping material over the printhead. Therefore, dry wiping usually requires a long length of available wiping material to provide a predetermined number of wipes, which is sufficient for the lifetime of the printhead. Accommodating a long length of wiping material is problematic for the overall design of inkjet printers. Moreover, in printers have relatively closely-spaced printheads (e.g. the digital inkjet press described in U.S. Pat. No. 8,529,014 or the wideformat printer described in U.S. Pat. No. 8,567,899, the contents of which are incorporated herein by reference), accommodating a length of wiping material for each printhead is particularly problematic in the relatively small volume of space available for maintaining each printhead.

A further problem with wiping printheads is the potential for damage to sensitive inkjet nozzles due to shear forces from the wiper or loose fibers becoming lodged in nozzles.

It would be desirable to provide a maintenance system for a printhead, which is suitable for wiping pigment-based inks and which can be accommodated in a relatively small volume of space.

It would be further desirable to provide a maintenance system, which minimizes an amount of wiping material employed over the lifetime of a printer.

It would be further desirable to provide a maintenance system, which minimizes the risk of damage to the printhead.

It would be further desirable to provide a means for priming inkjet nozzles, which places fewer design constraints on ink delivery systems.

SUMMARY OF THE INVENTION

In a first aspect, the present invention provides a maintenance system for maintaining an elongate inkjet printhead, the maintenance system comprising:

a carriage movable longitudinally along the printhead, the carriage comprising a maintenance member having a primary suction nozzle facing inkjet nozzles of the printhead and a wiper adjacent the primary suction nozzle;

a traversing mechanism for traversing the carriage longitudinally along the printhead; and an engagement mechanism for urging the wiper and the printhead into engagement with each other, wherein, in use, the wiper contacts a non-printing part of the printhead and the primary suction nozzle is spaced apart from the printhead.

The maintenance system of the present invention advantageously provides a hybrid maintenance member, which simultaneously primes and wipes an inkjet printhead. The primary suction nozzle sucks ink from the inkjet nozzles of the printhead during wiping so as to remove air bubbles and prime each inkjet nozzle with ink. This means of priming is highly efficient for removing air bubbles from ink. At the same time, any viscous plugs of ink and trapped fibers/particles are removed from the inkjet nozzles by the suction force Moreover, the maintenance system of the present invention obviates separate wiping and priming operations, thereby minimizing a total amount of time spent on maintenance interventions.

Any excess ink flooded transversely from the inkjet nozzles is wiped from the printhead during the traverse of the carriage using the wiper. Typically, a pair of wipers flank the primary suction nozzle so as to remove ink from non-printing portions of the printhead at either side of the row(s) of inkjet nozzles.

A further advantage of using suction to remove ink from the printhead via inkjet nozzles is that the printhead can be removed in a dry condition from the printer, when required. Hitherto, the Applicant has described methods for removing ink from printhead ink supply channels prior to printhead removal (see, for example, U.S. Pat. No. 8,474,955, the contents of which are incorporated herein by reference). However, the present invention enables complete removal of residual ink in printhead chips so that printhead replacement operations can be performed more cleanly.

Typically, the wiper is comprised of an absorbent material. Advantageously, a thickness of the absorbent material provides a robust means for controlling a distance between the primary suction nozzle and the inkjet nozzles. The amount of suction applied to the inkjet nozzles is critical for the effectiveness of both priming and wiping, and is dependent on the separation between the inkjet nozzles and the primary suction nozzle. Typically, the separation is in the range of 20 to 250 microns, or 30 to 100 microns.

Although suction nozzles have been proposed in the art (e.g. US2012/0098886) for maintaining inkjet printheads, the prior art systems require precise datuming methods to control this critical spacing. It is an advantage of the present invention that the thickness of the wiper itself is used to control the spacing between the primary suction nozzle and the inkjet nozzles, thereby obviating the requirement for precise datuming in the mechanical design of the maintenance system.

Preferably, the maintenance member has a secondary suction nozzle aligned with the absorbent material of each wiper such that the absorbent material is positioned between the printhead and each secondary suction nozzle. By applying suction through the absorbent material, an area of ink spread on the wiper during wiping is kept relatively small. Minimizing the area of ink spread means that relatively more wiping operations can be performed using the same wiper. A further advantage of employing suction through the porous wiping material is that liquid components of the ink are quickly drawn onto a non-wiping surface of the wiper opposite the wiping surface. This minimizes color mixing of inks via the absorbent material.

Preferably, the maintenance member comprises a suction manifold defining the primary and secondary suction nozzles. Each of the primary and secondary suction nozzles is typically connected to a vacuum source via a common vacuum port of the suction manifold.

Preferably, the maintenance member comprises a barrel having one or more suction manifolds circumferentially positioned about a surface thereof, each suction manifold being received in respective socket.

Preferably, the barrel is rotatably mounted about a fixed shaft having a valve orifice and an internal vacuum chamber, and wherein only one selected suction manifold communicates with the vacuum chamber when the selected suction manifold is aligned with the valve orifice.

Preferably, one or more lengths of absorbent material are mounted about an exterior surface of the barrel.

Preferably, the exterior surface of the barrel is profiled to complement a profile of the printhead. Typically, each suction manifold is comprised of a compliant polymeric material (e.g. polyurethane), which is moldable to complement the profile of the printhead.

Preferably, the barrel is polygonal in cross-section and comprises a plurality of maintenance faces.

Preferably, the barrel is axially rotatable and each maintenance face comprises a respective suction manifold.

Preferably, the maintenance member is resiliently biased the carriage towards the printhead.

In a second aspect, there is provided a method of maintaining an inkjet printhead comprising the steps of:

traversing a carriage having a maintenance member longitudinally along the printhead, the maintenance member comprising a primary suction nozzle facing inkjet nozzles of the printhead and a wiper adjacent the primary suction nozzle;

applying a vacuum pressure to inkjet nozzles of the printhead using the primary suction nozzle, the primary suction nozzle being spaced apart from the printhead; and simultaneously wiping a non-printing portion of the printhead using a wiper of the maintenance member, the wiper being positioned adjacent the primary suction nozzle and contacting the printhead.

Preferably, the maintenance member comprises a barrel having a plurality of maintenance faces, wherein the method further comprises the step of:

rotating the barrel to present a fresh maintenance face to the printhead after a predetermined number of wipes.

It will be appreciated that preferred embodiments described above in connection with the first aspect are, of course, equally applicable to the second aspect.

BRIEF DESCRIPTION OF THE DRAWINGS

Specific embodiments of the present invention will now be described by way of example only with reference to the accompanying drawings, in which:—

DETAILED DESCRIPTION OF THE INVENTION

Figure 1:
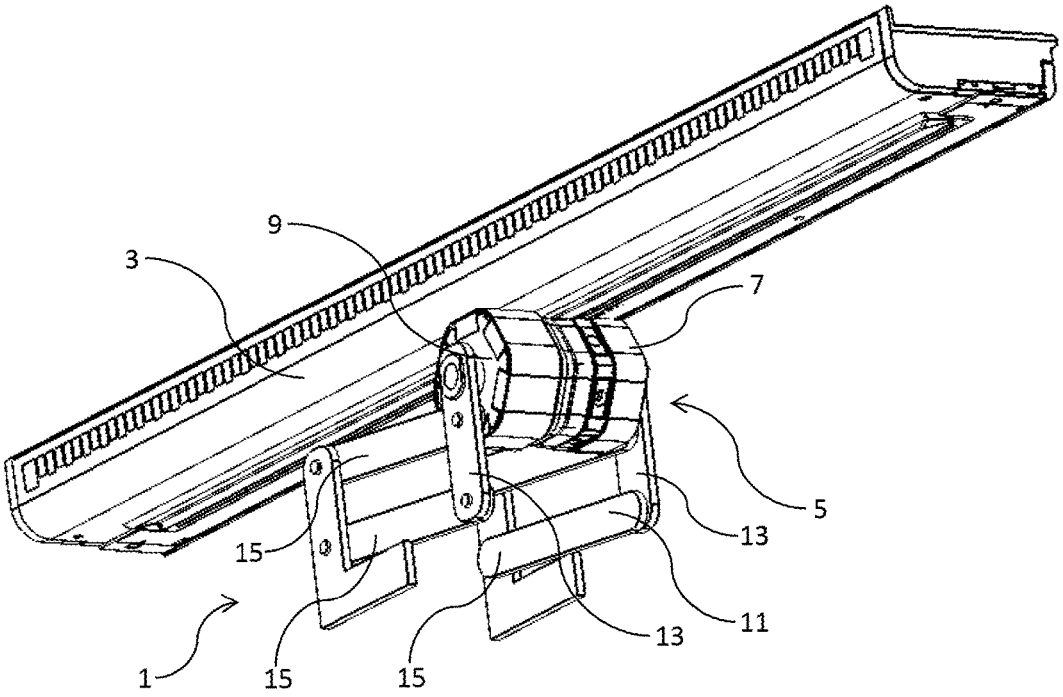
FIG. 1 is a perspective view of a maintenance system according to the first aspect.
Figure 2:
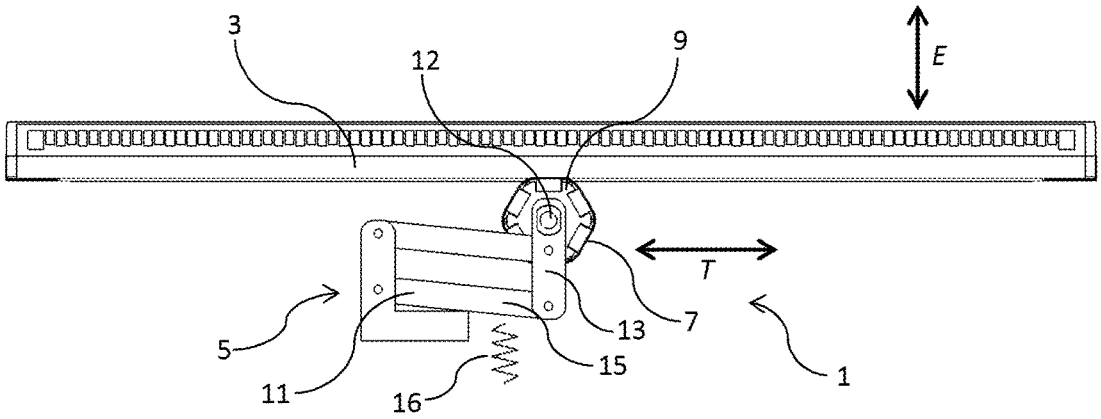
FIG. 2 is a side view of the maintenance system partway through a maintenance operation.

Referring to FIGS. 1 to 8, there is shown a maintenance system 1 for maintaining an elongate inkjet printhead 3, such as a pagewide printhead. The maintenance system comprises a carriage 5, which is movable longitudinally along the printhead 3 by means of a suitable traversing mechanism indicated schematically by double-headed arrow T. In FIG. 2, the carriage 5 is shown about halfway through a maintenance operation traversing from right-to-left as shown, and in FIG. 3 the carriage is shown in a nominal "home" position at the end of a maintenance operation.

The carriage 5 comprises a maintenance member 7 having a generally hexagonal barrel 9 mounted on a support frame 11. The barrel 9 is axially and rotatably mounted about a fixed shaft 12 supported between a pair of support rods 13 of the support frame 11, such that a rotational axis of the barrel is perpendicular to a longitudinal axis of the printhead 3. The barrel 9 is in a rotationally fixed position, relative to the support frame 11, during each maintenance operation.

The printhead 3 is operatively connected to an engagement mechanism, indicated schematically by double-headed arrow E, for reciprocally lifting and lowering the printhead relative to the maintenance member 7 for engagement and disengagement. In FIG. 2, the printhead 3 is shown in a lowered, engaged position and in FIG. 3 the printhead is shown in a raised, disengaged position. The support rods 13 are hingedly connected to arms 15 of the support structure 11, which resiliently bias the maintenance member 7 towards the printhead 3 by means of a spring mechanism 16. In this way, the maintenance member 7 is gently urged into contact with the printhead 3 when the printhead is lowered onto the maintenance member.

Various traversing and engagement mechanisms will be well known to the person skilled in the art. For example, the traversing mechanism may comprise a lead screw engaged with the carriage 5 for traversing the carriage along the length of the printhead 3. The engagement mechanism may comprise a rack-and-pinion mechanism or a scissor mechanism for lifting and lowering the printhead 3 relative to the carriage 5, or lifting and lowering the carriage relative to the printhead. Such mechanisms are well within the ambit of the person skilled in the art and will not be described in further detail herein.

Figure 7:
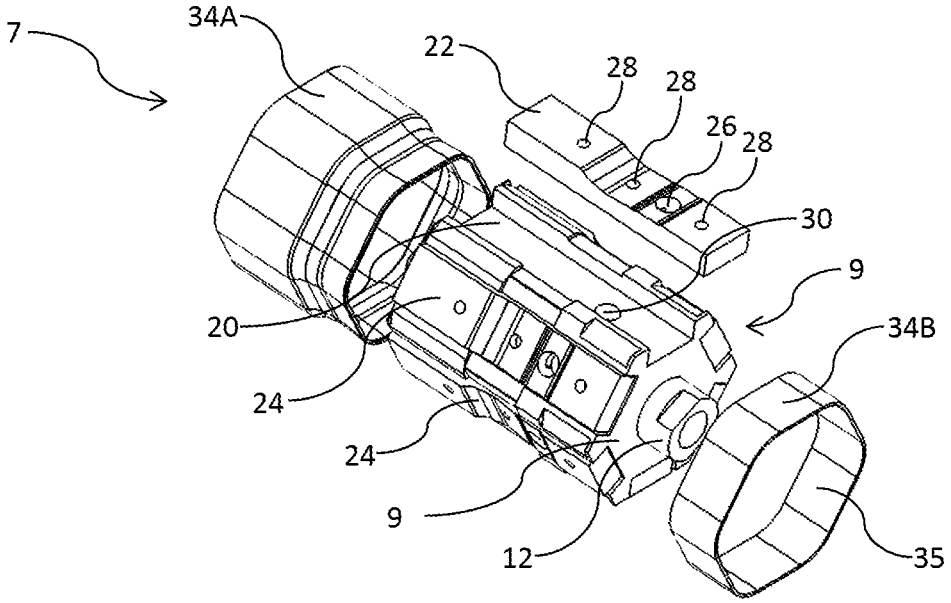
FIG. 7 is an exploded perspective view of the maintenance member.
Figure 8:
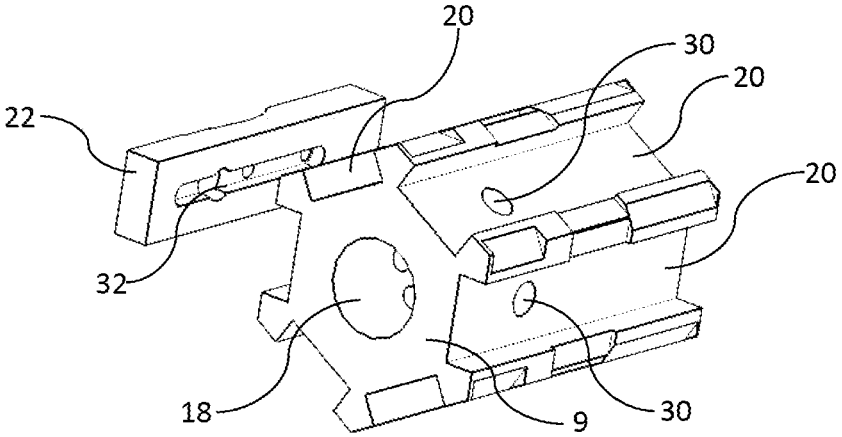
FIG. 8 is an exploded perspective view of a barrel having all but one suction manifold removed.

Referring to FIGS. 7 and 8, the barrel 9 has a central axial bore 18 and six hexagonally radial sockets 20 arranged about an exterior surface thereof, each socket receiving a respective suction manifold 22. The suction manifolds 22 are arranged in a generally hexagonal array and define six corresponding maintenance faces 24 of the maintenance member 7. Each suction manifold 22 is in the form of a bar comprised of a compliant material fixed to its respective complementary socket 20 by means of a suitable adhesive. Each suction manifold 22 defines a primary suction nozzle 26 and a plurality of secondary suction nozzles 28 spaced apart along the length of the suction manifold 22, with the secondary suction nozzles flanking the primary suction nozzle. Each of the primary and secondary suction nozzles 26 and 28 is in fluid communication with a vacuum port 30 of a respective socket 20 via an elongate slot 32 defined in a backside surface of the suction manifold 22.

Figure 5:
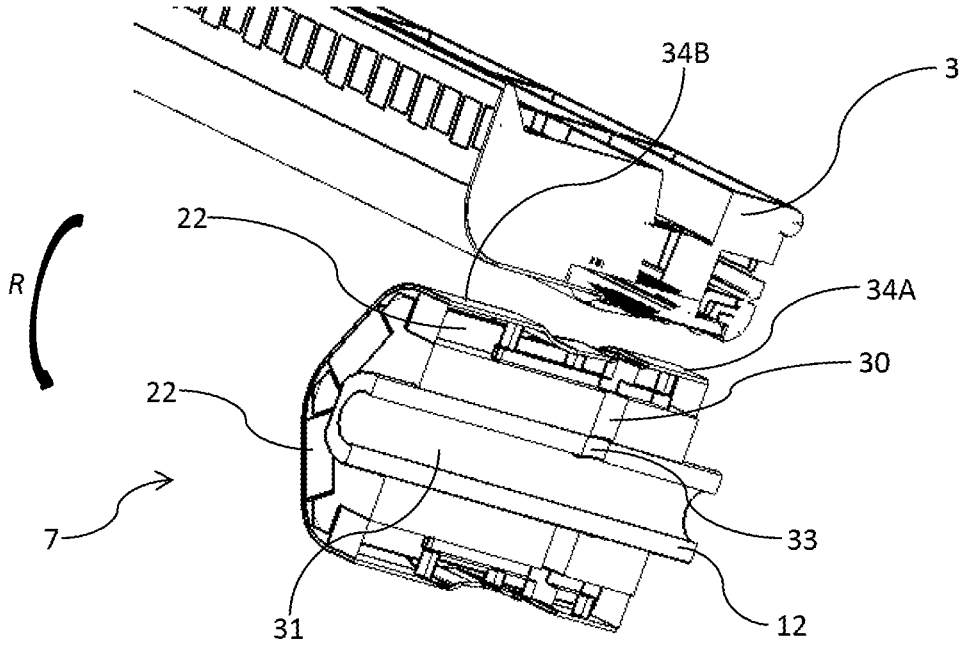
FIG. 5 is a sectional view of the maintenance system with the maintenance member disengaged from the printhead.

As best shown in FIG. 5, the barrel 9 is rotatably mounted about the fixed shaft 12, which is received in the axial bore 18 of the barrel. The shaft 12 is hollow and has an axial space defining a vacuum chamber 31, which is connected to a vacuum source (not shown) at one end. Only the suction manifold 22 facing the printhead 3 is connected to the vacuum chamber 31 by virtue of a valve orifice 33 defined in a wall of the shaft 12. When the vacuum port 30 of a printhead-facing socket 20 is aligned with the valve orifice 33, a corresponding printhead-facing suction manifold 22 is connected to the vacuum chamber 31 and the corresponding primary and secondary suction nozzles 26 and 28 consequently experience a suction force. Accordingly, rotation of the barrel 9 about the fixed shaft 12 provides a valve mechanism whereby only one selected suction manifold 22 facing the printhead 3 is connected to vacuum. Suitable indexing mechanisms (e.g. a ratchet-and-pawl indexing mechanism) for rotating the barrel 9 into each of the six maintenance positions will be well known to the person skilled in the art. The indexing mechanism is schematically indicated by arrow R in FIG. 5 and will not be described in further detail herein.

Figure 6:
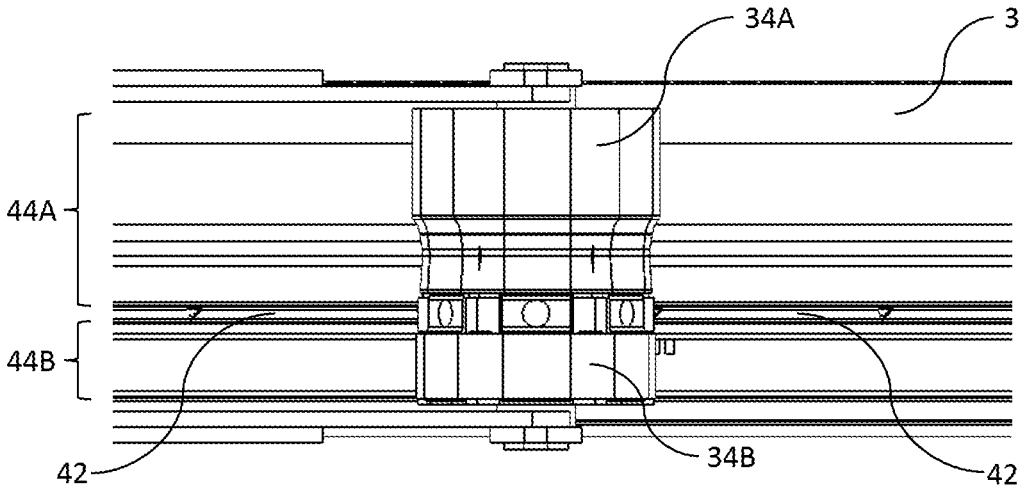
FIG. 6 is a bottom plan view of the maintenance system with the maintenance member engaged with the printhead.

Referring to FIGS. 5 to 7, first and second wipers 34A and 34B are circumferentially mounted about the barrel 9 so as to cover the secondary nozzles 28 of the suction manifolds 22, but not cover the primary suction nozzles 26. The first wiper 34A covers a pair of secondary suction nozzles 28 positioned at one side of the primary suction nozzle 26, while the second wiper 34B covers a single primary suction nozzle positioned at the other side of the primary suction nozzle. Each wiper is comprised of a length of absorbent material 35 having a predetermined thickness and porosity.

Figure 4:
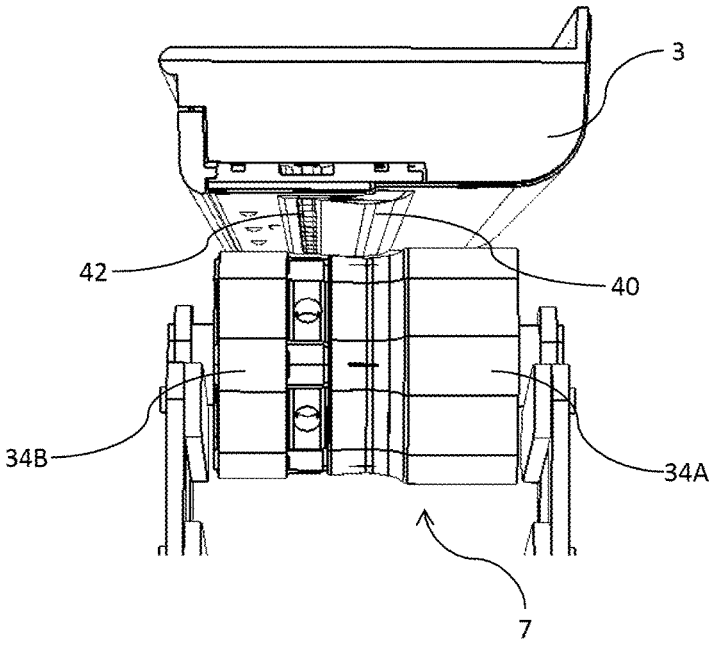
FIG. 4 is an end view of the maintenance system with a maintenance member disengaged from the printhead.

An upper surface of each suction manifold 22 is profiled to complement a lower face of the printhead 3, and the wipers 34A and 34B are similarly profiled by virtue of being intimately mounted about the barrel 9. As best seen in FIGS. 4 and 5, the lower face of the printhead 3 has a length of polymeric encapsulant material 40 extending outwardly therefrom to define a contoured printhead surface. This encapsulant material 40 extends along a length of the printhead and encapsulates wirebonds (not shown) providing power and data to a row of printhead chips 42. Each printhead chip 42 contains inkjet nozzles for printing onto print media.

During printhead maintenance, a control system (not shown) of a printer initiates the maintenance operation, either from a user intervention (e.g. a manual maintenance request in response to a decrease in print quality), or more usually as an automatic maintenance intervention based on a known printer condition (e.g. wake-up from an idle period, a predetermined period of the printhead being left uncapped, a predetermined number of prints etc.). The control system firstly configures the printhead 3 and the maintenance system 1 for performing printhead maintenance. For example, the control system may control the engagement mechanism E to align the carriage 5 with the printhead 3 and lower the printhead onto the maintenance member 7.

Referring to FIG. 6, when the printhead 3 is engaged with the maintenance member 7, the first wiper 34A contacts a first non-printing part 44A of the printhead 3 and the second wiper 34B contacts a second non-printing part 44B of the printhead, while the primary suction nozzle 26 is spaced apart from the printhead chips 42 containing rows of inkjet nozzles for printing. Resilient biasing of the maintenance member 7 by the spring mechanism, 16 connected to the support frame 11 provides a gentle force suitable for maintaining contact between the wipers 34 and the printhead 3 during maintenance operations.

Figure 9:
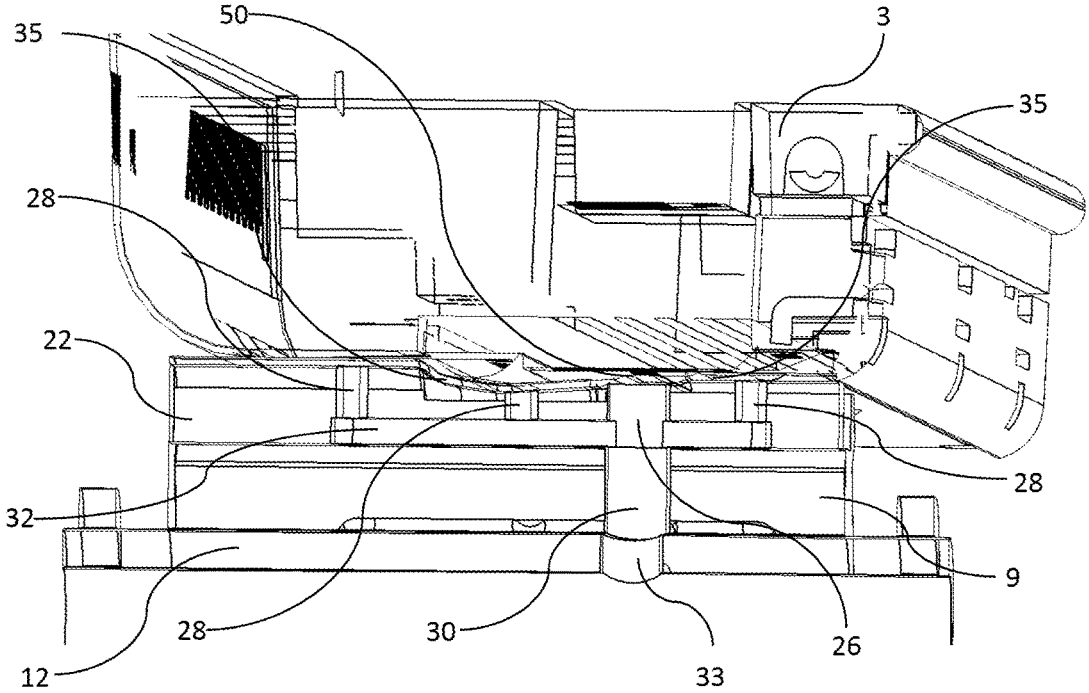
FIG. 9 is a magnified sectional of the maintenance system during a maintenance operation.

The primary suction nozzle 26, which is spaced apart from the printhead 3, is configured to remediate and prime the inkjet nozzles by sucking ink through the inkjet nozzles without potentially damaging contact therewith. At the same time, any flooded ink adjacent the inkjet nozzles may be wiped from the surface of the printhead 3 using the first and second wipers 34A and 34B cooperating with the secondary suction nozzles 28 juxtaposed the primary suction nozzle 26. Moreover, and referring now to FIG. 9, a critical gap 50 between the primary suction nozzle 26 and inkjet nozzles of the printhead 3 is controlled by a thickness of the absorbent material 35, which obviates complex mechanical arrangements for maintaining this critical separation.

The secondary suction nozzles 28 lying beneath the wipers 34A and 34B perform the important functions of: minimizing ink spread; removing wet ink from an exterior wiping surface of the wipers; and minimizing a required length of absorbent material. Hence, each maintenance face 24 of the maintenance member 7 is able to perform multiple traverses of the printhead for multiple maintenance operations. After a predetermined number of wipes, the barrel 9 may be rotated by the indexing mechanism R to present a fresh maintenance face 24 to the printhead 3 having fresh wiping portions of the absorbent material 35. Accordingly, the carriage 5 is not required to carry a relatively large spool of wiping material and can therefore be made very compact.

Figure 3:
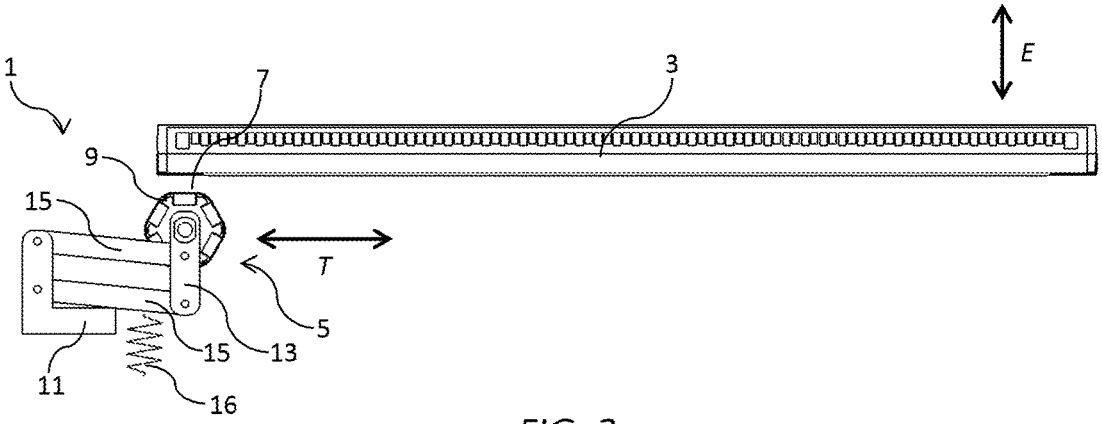
FIG. 3 is a side view of the maintenance system with a carriage in its home position.

As viewed in FIGS. 2 and 3, the carriage 5 is manoeuvred to the right-hand side of the printhead 3 and then begins its wiping traverse by moving towards the left-hand side of the printhead. The speed of the traverse is controlled by the control system and may depend on the type of maintenance required. For example, if wiping only is required then a relatively rapid traverse of the carriage 5 may be employed. Alternatively, if priming and wiping are required, then a relatively slower traverse may be employed in order to ensure full nozzle recovery.

For a typical wiping and priming operation, a vacuum pump (not shown) connected to the vacuum chamber 31 is switched on by the control system for the traverse of the carriage 5. With each of the wipers 34A and 34B contacting their respective non-printing parts 44A and 44B of the printhead 3, the primary suction nozzle 26 sucks ink from inkjet nozzles so as to prime each inkjet nozzle whilst the secondary suction nozzles 28 assist with wiping. As foreshadowed above, a footprint of ink on the wipers 34A and 34B is minimized by the use of suction so that liquid components of ink are rapidly sucked away from printhead 3.

The amount of vacuum pressure at the primary suction nozzle 26 may be controlled to control the type of maintenance operation. For example, deep inkjet nozzle priming may require more suction to unblock inkjet nozzles and remove fibers/particles. Alternatively, removal of air bubbles from printhead ink supply channels may requires less suction.

It will, of course, be appreciated that the present invention has been described by way of example only and that modifications of detail may be made within the scope of the invention, which is defined in the accompanying claims.

The invention claimed is:

1. A maintenance system for maintaining an elongate inkjet printhead, the maintenance system comprising:

a carriage movable longitudinally along the printhead, the carriage comprising a maintenance member having a primary suction nozzle facing inkjet nozzles of the printhead and a wiper adjacent the primary suction nozzle;

a traversing mechanism for traversing the carriage longitudinally along a lengthwise direction of the printhead; and an engagement mechanism for urging the wiper and the printhead into engagement with each other, wherein, in use, the wiper contacts only a non-printing part of the printhead and the primary suction nozzle is spaced apart from the printhead.

2. The maintenance of claim 1, wherein the maintenance member has a pair of wipers flanking the primary suction nozzle.

3. The maintenance system of claim 1, wherein the maintenance member is mounted on a support structure resiliently biasing the maintenance member towards the printhead.

4. The maintenance system of claim 1, wherein the wiper comprises an absorbent material, and wherein a thickness of the absorbent material at least partially determines a distance between the primary suction nozzle and the printhead.

5. The maintenance system of claim 4, wherein the maintenance member has a secondary suction nozzle aligned with the absorbent material of each wiper, the absorbent material being positioned between the printhead and the secondary suction nozzle.

6. The maintenance system of claim 5, wherein the maintenance member comprises a suction manifold defining the primary and secondary suction nozzles.

7. The maintenance system of claim 6, wherein the maintenance member comprises a barrel having one or more suction manifolds circumferentially positioned about a surface thereof, each suction manifold being received in respective socket.

8. The maintenance system of claim 7, wherein one or more lengths of absorbent material are mounted about an exterior surface of the barrel.

9. The maintenance system of claim 7, wherein the exterior surface of the barrel is profiled to complement a profile of the printhead.

10. The maintenance system of claim 7 wherein the barrel is rotatably mounted about a fixed shaft having a valve orifice and an internal vacuum chamber, and wherein only one selected suction manifold communicates with the vacuum chamber when the selected suction manifold is aligned with the valve orifice.

11. The maintenance system of claim 10, wherein the barrel is polygonal in cross-section and comprises a plurality of maintenance faces corresponding to the plurality of suction manfolds.

12. The maintenance system of claim 11, further comprising an indexing mechanism for rotating the barrel about the shaft and thereby presenting one of the maintenance faces to the printhead.

13. A method of maintaining an inkjet printhead comprising the steps of:

traversing a carriage having a maintenance member longitudinally along a lengthwise direction of the printhead, the maintenance member comprising a primary suction nozzle facing inkjet nozzles of the printhead and a wiper adjacent the primary suction nozzle;

applying a vacuum pressure to inkjet nozzles of the printhead using the primary suction nozzle, the primary suction nozzle being spaced apart from the printhead; and simultaneously wiping only a non-printing portion of the printhead using a wiper of the maintenance member, the wiper being positioned adjacent the primary suction nozzle and contacting the printhead.

14. The method of claim 13, wherein the maintenance member comprises a barrel having a plurality of maintenance faces, and wherein the method further comprises the step of:

rotating the barrel to present a fresh maintenance face to the printhead after a predetermined number of wipes.

* * * * *